United States Patent [19]

Akiba

[11] Patent Number: 4,566,858

[45] Date of Patent: Jan. 28, 1986

[54] PULSATION-FREE VOLUMETRIC PUMP

[75] Inventor: Takashi Akiba, Tokyo, Japan

[73] Assignee: Nikkiso Co., Ltd., Tokyo, Japan

[21] Appl. No.: 619,738

[22] Filed: Jun. 12, 1984

Related U.S. Application Data

[63] Continuation-in-part of Ser. No. 309,579, Oct. 8, 1981, abandoned.

[51] Int. Cl.[4] ..... F04B 49/06; F04B 49/08

[52] U.S. Cl. ..... 417/22; 417/45

[58] Field of Search ..... 417/18–22, 417/44, 45, 269; 92/129

[56] References Cited

U.S. PATENT DOCUMENTS

| | | | |
|---|---|---|---|
| 3,847,507 | 11/1974 | Sakiyama | 417/45 |
| 3,882,861 | 5/1975 | Kettering et al. | 417/44 |
| 3,976,400 | 8/1976 | Major | 92/129 |
| 4,155,683 | 5/1979 | Mochizuki | 417/269 |

*Primary Examiner*—William L. Freeh

[57] ABSTRACT

An improved pulsation-free reciprocating volumetric pump is disclosed, which comprises two reciprocating plungers, a cam for driving said plungers, a driving motor connected to said cam, a circuit connected to said driving motor for controlling rotational rate, and another circuit for detecting a pressure of combined volume discharged by the two plungers and for correcting a control signal of said rotation controlling circuit through the detected signal.

2 Claims, 7 Drawing Figures

FIG.1
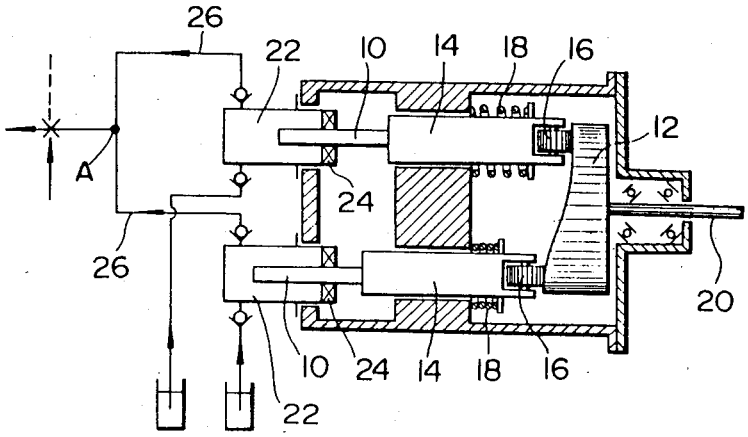
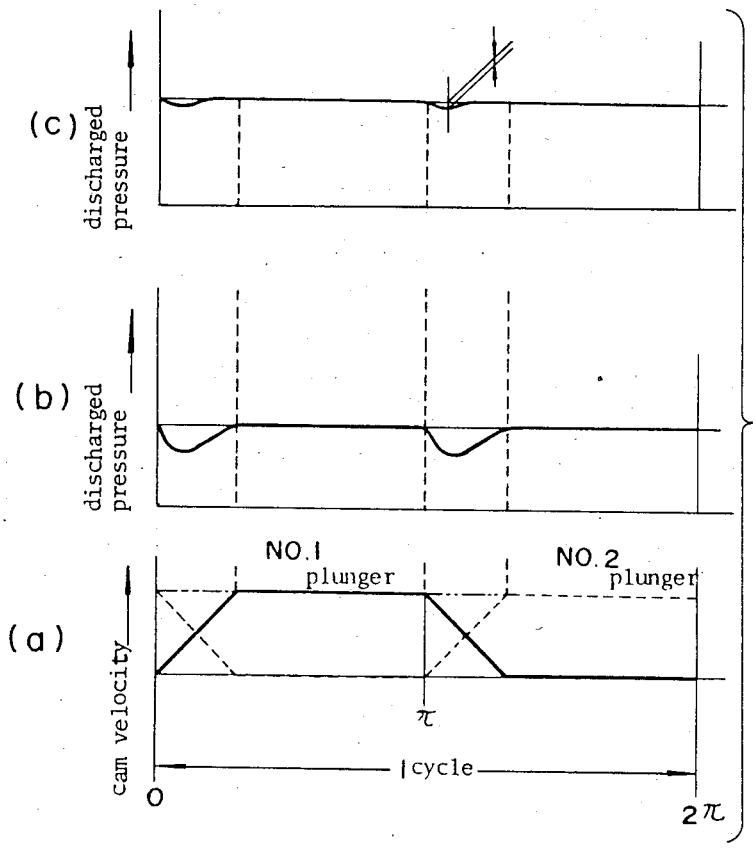
FIG.2

FIG. 3
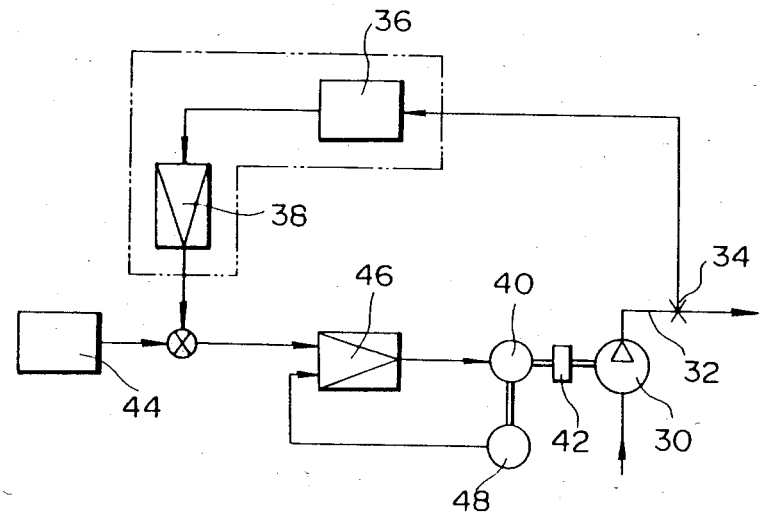
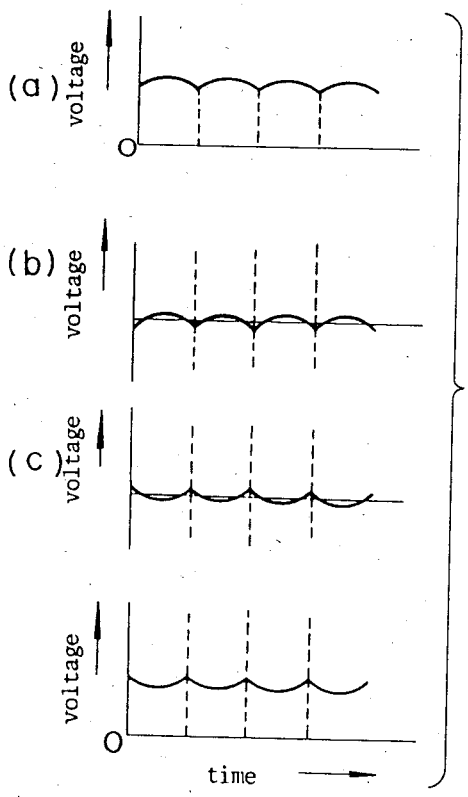
FIG. 4

PRESSURE DETECTOR

DC ELIMINATING CIRCUIT

ROTATION SETTING CIRCUIT

PULSATION-FREE VOLUMETRIC PUMP

FIELD OF THE INVENTION

This application is a application of the U.S. Pat. application Ser. No. 309,579 filed 10/8/81 which has now been abandanded.

This invention relates to an improvement in a pulsation-free volumetric pump utilizing a reciprocating plunger-type pump, and more particularly, to an improvement in a controlling mechanism for stabilizing the pulsation-free property of the pump.

BACKGROUND OF THE INVENTION

In general, the reciprocating pump of single plunger type generates a greater pulsation of discharged fluid because of its discharge volume of zero upon suction stroke. In order to avoid such pulsation of the discharged fluid, a pump for controlling the total discharge volume to a constant volume has been proposed, in which two plungers of the same diameter are arranged in such a manner that the reciprocating phase of each plunger is shifted by ½ cycle from each other. In such type of the pump, one or two cams having a special curved face are used for providing a constant total volume discharged by the plungers, as described hereinbefore, whereby the combined volume discharged by pumping action of the two plungers may be theoretically free of pulsation. An embodiment of such type of the pulsation-free reciprocating plunger pump is illustrated in FIG. 1, wherein the two plungers 10, 10 are reciprocated by means of the cam driving for providing a combined volume discharged through pumping action of these plungers. The pair of plungers 10, 10 are arranged in parallel, with which is engaged a single rotary cam 12 having a cam surface at its one end. The cam surface is machined so as to provide a curved surface for keeping the constant combined volume discharged by the pumping action of the two plungers, which move along the periphery of the cam surface. In FIG. 1, each cross-head 14, 14 for transmitting a displacement of the rotary cam 12 to each plunger 10, 10 is provided with each of cam followers 16, 16 which is pressed against the cam surface by each spring 18, 18 arranged around the cross-head 14, 14. Further, the rotary cam 12 is provided at its center of opposite surface with a rotary shaft 20 to form a cantilever structure. The plungers 10, 10 are inserted through glad seals 24, 24 into respective pump chambers 22, 22, from which are derived discharge pipings 26, 26 which in turn are joined together at a point A.

Thus, the pump as illustrated in FIG. 1 may obtain, from its constructional view points, the pulsation-free property as shown in FIG. 2(*a*) and provide the pulsation-free combined discharge volume. However, it is difficult to completely avoid the pulsation of the combined discharge volume due to the following factors:

(1) A rounded portion must be provided at an inflexion point of the cam upon machining.

(2) Velocity characteristics of the cam or the plunger can be varied due to the machining error of the cam.

(3) Accurate and strick machining and arrangement of the cam must be effected for shifting the phase of two plungers in 180° from each other.

(4) A slight back-flow occurs through a check valve connected to a line leading to the pump.

(5) A pumping liquid has its intrinsic compression.

(6) A pumping liquid contains air bubbles and particles.

As a measure for correcting the factors (4) and (5) listed hereinabove, which vary rather regularly, the following two methods have been proposed:

[I] A method in which a velocity curve of cam is designed so as to increase a velocity of plunger only in a given range of a beginning delivery stroke of the plunger, thereby to correct the reduction of discharge volume due to the compression of liquid and the back-flow through the valve.

[II] A method in which discharging pressures are determined for several strokes of the plunger to obtain an average valve, to which is approached a discharging pressure of subsequent stroke.

However, the former method has such the disadvantages that the pulsation nevertheless increases in a zone having a relative low discharging pressure because of less compression or less back-flow of the liquid, and that the effect of reducing the pulsation through correction decreases as the pressure applied by a corrected curve of the cam is deviated from the pressure actually employed. On the other hand, the latter method has such the disadvantage that the average discharging pressure determined for several strokes can not be followed up the variation in the actual discharging pressure. Furthermore, the methods I and II have a common disadvantage in that an irrefular pulsation incapable of being responded appears so that the variation in the actual discharge volume depends largely on the cam characteristics.

Now it has been found out that the problems and disadvantages described hereinbefore may be solved all at once by the arrangement in that a cam for driving two plungers is connected to a driving motor, to which is in turn connected a rotation controlling circuit, while a pressure detector is provided for detecting a pressure of combined discharge volume and that a variable pressure signal in the pressure detector is fed to the rotation controlling circuit as a corrected signal.

SUMMARY OF THE INVENTION

Accordingly, a general object of the invention is to provide a pulsation-free volumetric pump which is simple in construction and may allow the stable and pulsation-free volumetric pumping.

A principal object of the invention is to provide a pulsation-free reciprocating volumetric pump comprising a pump housing having two plungers providing a combined discharge volume, a cam for driving said plungers, a direct current driving motor connected to said cam, a rotation setting means operatively connected to said driving motor for supplying thereto a predetermined direct current voltage for driving the motor at a predetermined ratational rate, a main amplifier operatively connected to said rotation setting means for supply thereto as a first input the direct current voltage from the rotation setting means, said main amplifier having an output supplied to said drive motor, a tachegenerator operatively connected to said drive motor for drive thereby and suppling its output voltage as a second input to said main amplifier, and means for compensating for pressure pulsations produced during pumping, said last-named means comprising a pressure detector for detecting the pressure of said combined discharge volume and providing an output signal having a direct current component and an alternating current component representative of said pressure pulsations, means eliminating the direct current component of the pressure detector output signal and passing only the alternating current component, an amplifier circuit for amplifying the alternating current component, and adding means supplied with the direct current voltage from the rotation setting means and with the amplified alternating current component from the amplifier circuit for adding said alternating current component, after phase reversal, to the direct current voltage from the rotation setting means for modifying said first input voltage to said main amplifier in a sense to modify the rotation rate of the drive motor to compensate for said pressure pulsations.

Now the invention will be described in more detail hereinafter with reference to the drawings which illustrate the preferable embodiments.

BRIEF DESCRIPTION OF THE DRAWINGS

FIG. 1 is a schematic illustration shwoing one embodiment of the pump structure in the pulsation-free volumetric pump according to the invention;

FIGS. 2(*a*) to (*c*) show pulsation-free characteristic curves obtained by the pump of FIG. 1;

FIG. 3 is a diagram showing a controlling system for the pulsation-free volumetric pump according to the invention;

FIGS. 4(*a*) to (*c*) show working characteristic curves obtained by the controlling system of FIG. 3;

PREFERRED EMBODIMENT OF THE INVENTION

Figure 5:
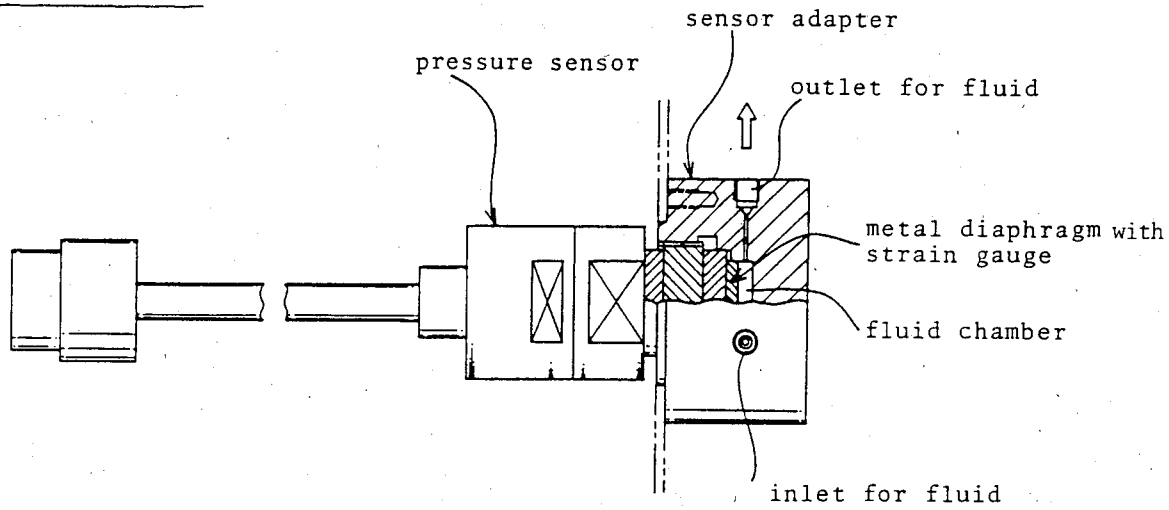
FIG. 5 is a schematic view of a pressure detector useful in the pump according to the invention.
Figure 6:
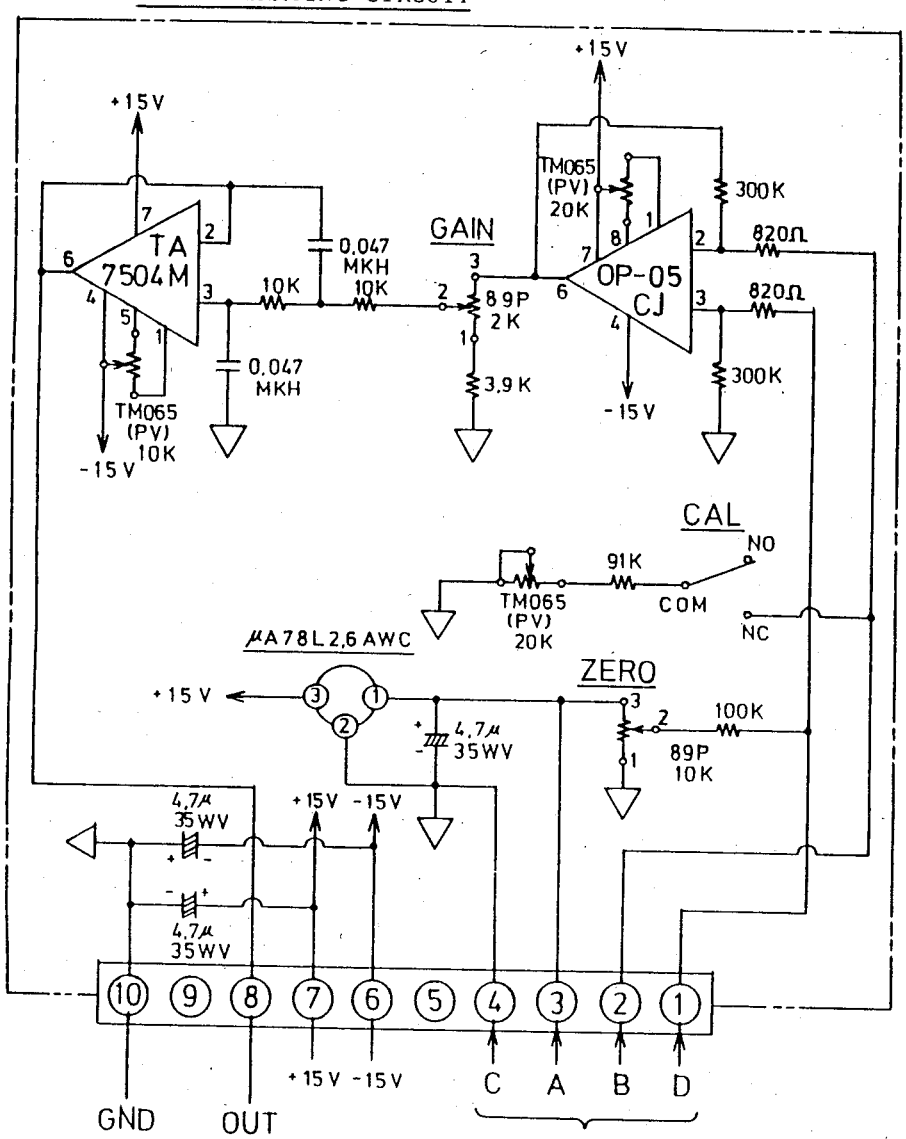
FIG. 6 shows a DC eliminating circuit useful in the pump according to the invention.
Figure 7:
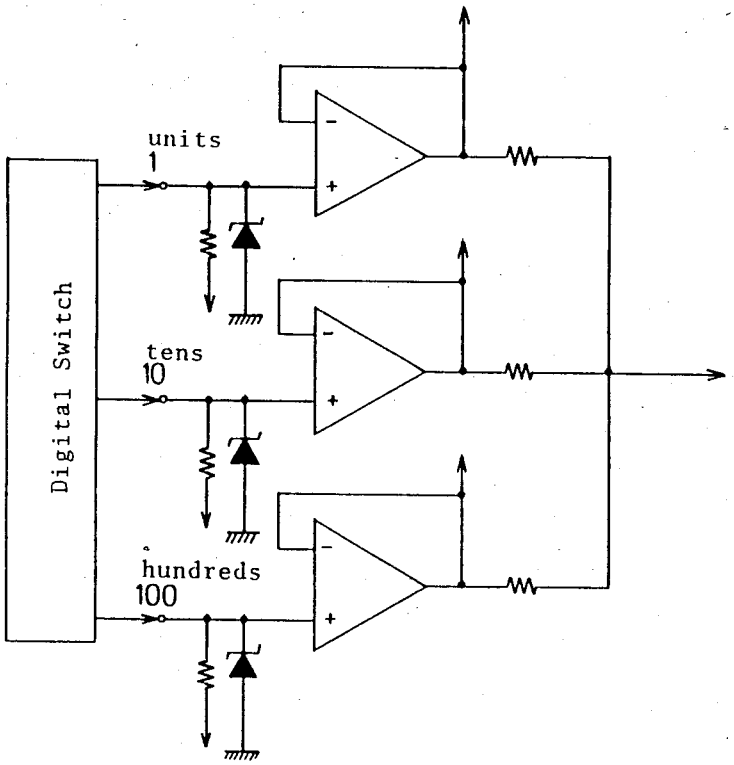
FIG. 7 shows a rotation setting circuit useful in the pumps according to the invention.

FIG. 3 illustrates a diagram of a controlling system for the pump according to the invention, wherein the reference 30 shows a reciprocating plunger-type pump having two plungers as shown, for example, in FIG. 1. From two pumping chambers of the plunger-type pump 30 are derived respective discharge pipings which are joined together to form a piping 32, to which is connected a pressure detector 34. As shown in FIG. 4, the pressure detector 34 is formed of a pressure sensor utilizing a strain gauge, in which a fluid chamber in a sensor adapter is provided with a metal diaphragm having the strain gauge and is fed with fluid. Thus, deviation of the diaphragm in response to a pressure change within the fluid chamber is converted through the strain gauge to an electric signal corresponding to the pressure. The signal comprising a DC component with an AC ripple is thus provided by the pressure detector 34 and is fed through a DC eliminating circuit 36 for eliminating the DC component and an amplifying circuit 38 for amplifying the AC ripple voltage passed by the DC eliminating circuit 36. As shown in FIG. 6, the DC eliminating circuit 36 receives output signals from the strain gauge of the pressure detector 34 and give required ripple voltage signals to output terminals after a plurality of calculation amplifying circuits has conducted zero adjustment, gain adjustment, elimination of the DC component, and wave shaping. On the other hand, there is provided a driving motor 40 for driving a rotary cam of the plunge-type pump 30, an output of which motor 40 is transmitted to the rotary cam shaft optionally through a convenient gear 42. The driving motor 40 is controlled for its rotational rate through a main amplifier 46, while the rotational rate provided by the rotation setting circuit 44 is corrected by the signal from the pressure detector 34. As shown in FIG. 7, the rotation setting circuit 44 is formed as a voltage setting circuit including a voltage amplifying circuit which utilizes a voltage change due to adjustment of resistance. The voltage setting circuit is able to set digital numbers of three figures (000–999), for example, through a digital switch. The digital numbers may correspond to the discharge rate (000–999 ml/min.) of the pump to be controlled. Further, to the driving motor 40 is connected a tachogenerator 48, an output of which is fed back to the main amplifier 46. The tachogenerator 48 is an element for feedback control which has been used for known motor control. When there is no ripple voltage, the amplifier 46 compares setting voltage of the circuit 44 with the detected voltage of the tachogenerator 48 and gives an output instruction signal when the actual rotation rate of the motor corresponds to the rotational rate based on the setting voltage of the circuit 44. When there is a ripple voltage added to the output from the circuit 44, the amplifier 46 also gives the same output instruction signal as in the above situation, containing the ripple portion.

The working of the pump according to the invention will be described hereinbelow with reference to the working characteristics, as shown in FIG. 4.

When a somehwat pulsation appears in the working characteristics of the plunger-type pump 30, an output signal as shown in FIG. 4(*a*) is obtained in the pressure detector 34. In this case, the resulting output signal is freed from a DC component by the DC eliminating means 36 for eliminating the DC component, because only the variable or ripple portion is to be passed. Then the signal after elimination of the DC component is amplified by the amplifying circuit 38 to give a characteristic curve, as shown in FIG. 4(*b*). The signal thus obtained is converted to a reverse phase, as shown in FIG. 4(*c*), and added to a signal from the rotation setting circuit 44, and thereafter fed to the main amplifier 46 for obtaining an output, as shown in FIG. 4(*d*). Thus, if the pressure detected by the detector 34 increases, then the rotational rate of the driving motor 40 may be decreased. On the contrary, if the pressure detected by the detector 34 decreases, then the rotational rate of the driving motor 40 may be increased. In this way, in accordance with the invention, the variation in the discharging pressure of the pump may be kept extremely low through detection of the discharging pressure and thereby negative feed-back control of the rotational rate of the driving motor.

In order to control the pump according to the invention most effectively, the inertia of each component should be kept as low as possible, and especially a response characteristic of the driving motor 40 is most important. For this purpose, various experiments have been carried out to find out that the pulsation may be readily reduced to much lower level, for example one fifth or lower, in comparison with the conventional system only based on the cam property, by use of a DC motor having a mechanical time constant below 12 msec. When the mechanical time constant is higher than 15 msec., it has been found out that the variation of the discharging pressure is difficult to be sufficiently followed up and controlled, so that the reduction of pulsation could not be expected. The mechanical time constant for the DC motor determines high velocity response for start-up time constant or start-up time and is represented by the formula:

$$T=(GD^2\times N/374\times T_M)$$

wherein N represents maximum velocity of the motor(RPM), $T_M$ represents motor torque (Kg.m), and $GD^2$ represents a flywheel effect of a machine and motor calculated for a motor shaft(Kg.m), in which G is total weight(Kg) and D is an equivalent rotational diameter(m).

It will be appreciated from the embodiment described hereinbefore that the pump according to the invention has such the advantages that the pulsation of the discharged fluid from the pump may be corrected and controlled by means of the electrical means, thereby allowing the electrical correction of the ripple in the discharging pressure without replacing the cam, and that the magnitude of pulsation may be suitably controlled within the desired range, as shown in FIG. 2(*c*).

Although the invention has been described hereinabove with the reciprocating plunger-type pump as shown in FIG. 1, it will be appreciated that the invention may be applied widely and effectively to many other types of pulsation-free volumetric pumps.

The foregoing is descriptive of an embodiment of the pulsation-free volumetric pump, and many changes and modifications may be made without departing from the scope and spirit of the invention.

What is claimed is:

1. A pulsation-free reciprocating volumetric pump comprising a pump housing having two plungers providing a combined discharge volume, a cam for driving said plungers, a direct current driving motor connected to said cam, a rotation setting means operatively connected to said driving motor for supplying thereto a predetermined direct current voltage for driving the motor at a predetermined rotational rate, a main amplifier operatively connected to said rotation setteing means for supply thereto as a first input the direct current voltage from the rotation setting means, said main amplifier having an output supplied to said drive motor, a tachogenerator operatively connected to said drive motor for drive thereby and supplying its output voltage as a second input to said main amplifier, and means for compensating for pressure pulsations produced during pumping, said last-named means comprising a pressure detector for detecting the pressure of said combined discharge volume and providing an output signal having a direct current component and an alternating current component representative of said pressure pulsations, means eliminating the direct current component of the pressure detector output signal and passing only the alternating current component, an amplifier circuit for amplifying the alternating current component, and adding means supplied with the direct current voltage from the rotation setting means and with the amplified alternating current component from the amplifier circuit for adding said alternating current component, after phase reversal, to the direct current voltage from the rotation setting means for modifying said first input voltage to said main amplifier in a sense to modify the rotation rate of the drive motor to compensate for said pressure pulsations.

2. A pulsation-free reciprocating volumetric pump as claimed in any one of claim 1, wherein the driving motor comprises a direct current motor having a mechanical time constant below 12 msec.

* * * * *